US010597611B2

(12) United States Patent
Oberlin et al.

(10) Patent No.: US 10,597,611 B2
(45) Date of Patent: Mar. 24, 2020

(54) DETERGENT FORMULATIONS WITH HIGH WATER CONTENT AND ANTI-REDEPOSITION POLYMERS

(71) Applicants: Dow Global Technologies LLC, Midland, MI (US); Rohm and Haas Company, Collegeville, PA (US)

(72) Inventors: Anne Oberlin, Antibes (FR); Asghar A. Peera, Royersford, PA (US); Scott Backer, Phoenixville, PA (US); Matthew J. Jansma, Midland, MI (US)

(73) Assignees: Dow Global Technologies LLC, Midland, MI (US); Rohm and Haas Company, Collegeville, PA (US)

( * ) Notice: Subject to any disclaimer, the term of this patent is extended or adjusted under 35 U.S.C. 154(b) by 0 days.

(21) Appl. No.: 16/315,367

(22) PCT Filed: Jul. 7, 2017

(86) PCT No.: PCT/US2017/040998
§ 371 (c)(1),
(2) Date: Jan. 4, 2019

(87) PCT Pub. No.: WO2018/013407
PCT Pub. Date: Jan. 18, 2018

(65) Prior Publication Data

US 2019/0309239 A1 Oct. 10, 2019

(30) Foreign Application Priority Data

Jul. 11, 2016 (EP) ..... 16290134

(51) Int. Cl.

| | |
|---|---|
| ***C11D 1/00*** | (2006.01) |
| ***C11D 3/37*** | (2006.01) |
| *C11D 3/00* | (2006.01) |

(52) U.S. Cl.
CPC ..... *C11D 3/3765* (2013.01); *C11D 3/0036* (2013.01)

(58) Field of Classification Search
CPC ..... C11D 1/00; C11D 3/37; C11D 3/3707; C11D 3/3746; C11D 3/3765
See application file for complete search history.

(56) References Cited

U.S. PATENT DOCUMENTS

| | | | | |
|---|---|---|---|---|
| 4,797,223 | A | 1/1989 | Amick et al. | |
| 5,130,369 | A | 7/1992 | Hughes et al. | |
| 10,351,806 | B2 * | 7/2019 | Oberlin | C11D 3/0036 |
| 2012/0165242 | A1 * | 6/2012 | Ng | C11D 3/3757 510/476 |

FOREIGN PATENT DOCUMENTS

| | | | |
|---|---|---|---|
| WO | 201407221 | A1 | 1/2014 |
| WO | 2017139184 | A1 | 8/2017 |

* cited by examiner

*Primary Examiner* — Brian P Mruk
(74) *Attorney, Agent, or Firm* — Kenneth Crimaldi

(57) ABSTRACT

A liquid detergent comprising: (a) from 30 to 80 wt % water; (b) from 5 to 50 wt % surfactants; and (c) from 0.5 to 10 wt % of an acrylic polymer comprising from 20 to 50 wt % polymerized units of (meth)acrylic acid and from 50 to 80 wt % polymerized units of a monomer of structure $H_2C{=}C(R)CO_2(CH_2CH_2O)_n(CH(R')CH_2O)_mR''$; wherein R is H or $CH_3$, R' is $C_1$-$C_2$ alkyl; R'' is $C_8$-$C_{22}$ alkyl or $C_8$-$C_{16}$ alkylphenyl; n is an average number from 6-30 and m is an average number from 0-10, provided that n≥m and m+n is 6-30.

9 Claims, No Drawings

DETERGENT FORMULATIONS WITH HIGH WATER CONTENT AND ANTI-REDEPOSITION POLYMERS

This invention relates to heavy-duty laundry (HDL) detergent formulations.

Bleach is not an option for formulators in the HDL space, and so additives beyond enzymes and surfactants are needed. The use of acrylic polymers as anti-redeposition additives are known, e.g., in U.S. Pat. No. 4,797,223. However, this reference does not suggest the use of the detergent formulations claimed herein.

The problem solved by this invention is the need for improved heavy-duty laundry (HDL) detergent formulations.

STATEMENT OF THE INVENTION

The present invention provides a liquid detergent comprising: (a) from 30 to 80 wt % water; (b) from 5 to 50 wt % surfactants; and (c) from 0.5 to 10 wt % of an acrylic polymer comprising from 20 to 50 wt % polymerized units of (meth)acrylic acid and from 50 to 80 wt % polymerized units of a monomer of structure $H_2C{=}C(R)CO_2(CH_2CH_2O)_n(CH(R')CH_2O)_mR''$; wherein R is H or $CH_3$, R' is $C_1$-$C_2$ alkyl; R" is $C_8$-$C_{22}$ alkyl or $C_8$-$C_{16}$ alkylphenyl; n is an average number from 6-30 and m is an average number from 0-10, provided that n≥m and m+n is 6-30.

DETAILED DESCRIPTION

Percentages are weight percentages (wt %) and temperatures are in ° C. unless specified otherwise. Operations were performed at room temperature (20-25° C.) unless specified otherwise. Weight percentages of components in detergent are based on weights of active ingredients, e.g., surfactant molecules without any water that may be in a commercial surfactant product and on the weight of the entire liquid laundry detergent composition, including water. Percentages of monomer units in the acrylic polymer are based on total weight of the polymer chains, i.e., dry weight. The term "(meth)acrylic" means methacrylic or acrylic. Alkyl groups are saturated hydrocarbyl groups that may be straight or branched. Aralkyl groups are alkyl groups substituted by aryl groups. Examples of aralkyl groups include, e.g., benzyl, 2-phenylethyl and 1-phenylethyl. As used herein the term "surfactant" includes fatty acid soaps.

As used herein, unless otherwise indicated, the phrase "molecular weight" or Mw refers to the weight average molecular weight as measured in a conventional manner with gel permeation chromatography (GPC) and polyacrylic acid standards. GPC techniques are discussed in detail in Modem Size Exclusion Chromatography, W. W. Yau, J. J. Kirkland, D. D. Bly; Wiley-Interscience, 1979, and in A Guide to Materials Characterization and Chemical Analysis, J. P. Sibilia; VCH, 1988, p. 81-84. Molecular weights are reported herein in units of Daltons.

Preferably, the detergent comprises at least 1 wt % of the acrylic polymer, preferably at least 1.5 wt %, preferably at least 2 wt %, preferably at least 2.5 wt %, preferably at least 3 wt %; preferably no more than 8 wt %, preferably no more than 7 wt %, preferably no more than 6 wt %.

Preferably, the polymer is an acrylic polymer, i.e., one having at least 60 wt % polymerized residues of acrylic monomers, preferably at least 75 wt %, preferably at least 80 wt %, preferably at least 90 wt %, preferably at least 95 wt %, preferably at least 98 wt %. Acrylic monomers include (meth)acrylic acids and their $C_1$-$C_{22}$ alkyl or hydroxyalkyl esters, including monomers of structure $H_2C{=}C(R)CO_2(CH_2CH_2O)_n(CH(R')CH_2O)_mR''$, crotonic acid, itaconic acid, fumaric acid, maleic acid, maleic anhydride, (meth) acrylamides, (meth)acrylonitrile and alkyl or hydroxyalkyl esters of crotonic acid, itaconic acid, fumaric acid or maleic acid.

Preferably, the acrylic polymer comprises at least 55 wt % polymerized units of a monomer of structure $H_2C{=}C(R)CO_2(CH_2CH_2O)_n(CH(R')CH_2O)_mR''$, preferably at least 60 wt %, preferably at least 65 wt %; preferably no more than 77 wt %, preferably no more than 75 wt %. Preferably, the acrylic polymer comprises at least 23 wt % polymerized units of (meth)acrylic acid, preferably at least 25 wt %; preferably no more than 45 wt %, preferably no more than 40 wt %, preferably no more than 35 wt %.

Preferably, R is H or $CH_3$. Preferably, R' is $CH_3$. Preferably, n is at least 8, preferably at least 10; preferably n is no greater than 25, preferably no greater than 20, preferably no greater than 15. Preferably, m is no greater than 5, preferably no greater than 3, preferably no greater than 1, preferably zero. Preferably, R" is $C_8$-$C_{18}$ alkyl or $C_8$-$C_{16}$ alkylphenyl, preferably $C_8$-$C_{18}$ alkyl, preferably $C_{10}$-$C_{16}$ alkyl. In a preferred embodiment, R" is a mixture of substituents from $C_{10}$-$C_{16}$ alkyl, preferably R" is $C_{12}$-$C_{15}$ alkyl.

Preferably, the weight-average molecular weight (Mw) of the acrylic polymer is from 1,000 to 10,000; preferably at least 1,500; preferably no greater than 7,000, preferably no greater than 5,000, preferably no greater than 4,000, preferably no greater than 3,000.

Preferably, the acrylic acid polymer comprises no more than 0.5 wt % polymerized units of crosslinking monomers, preferably no more than 0.3 wt %, preferably no more than 0.1 wt %, preferably no more than 0.05 wt %, preferably no more than 0.02 wt %. A crosslinking monomer is a multiethylenically unsaturated monomer. Preferably, the detergent formulation comprises no more than 0.5 wt % of a metal ion selected from the group consisting of $Zn^{+2}$, $Ca^{+2}$, $Mg^{+2}$ and $Al^{+3}$, preferably no more than 0.3 wt %, preferably no more than 0.2 wt %, preferably no more than 0.1 wt %. Percentages of metal ions are based on metal alone, without the anion.

Preferably, the detergent comprises at least 10 wt % surfactants, preferably at least 15 wt %, preferably at least 20 wt %; preferably no more than 40 wt %; preferably no more than 35 wt %. Preferably, the detergent comprises at least 35 wt % water, preferably at least 40 wt %, preferably at least 45 wt %; preferably no more than 70 wt %, preferably no more than 65 wt %, preferably no more than 60 wt %.

The surfactant(s) may be cationic, anionic, nonionic, fatty acid metal salt, zwitterionic or betaine surfactants. Preferably, the formulation comprises at least one anionic surfactant, preferably at least two. Preferably, nonionic surfactants have an alkyl group having at least six carbon atoms and at least five polymerized ethylene oxide or propylene oxide residues. Preferably, nonionic surfactants have at least five polymerized ethylene oxide residues, preferably at least six, preferably at least seven; preferably no more than twelve, preferably no more than eleven, preferably no more than ten. Preferably, anionic surfactants have an alkyl group having at least ten carbon atoms and an anionic group, preferably selected from sulfonates and sulfates. Anionic surfactants also may have polymerized residues of ethylene oxide, and/or may have aromatic rings, e.g., linear alkylbenzene sulfonates. Some anionic surfactants are fatty acid alkali metal salts. Preferably, the detergent composition comprises from 5 to 20 wt % linear alkylbenzene sulfonates, preferably 8 to 18 wt %, preferably 10 to 18 wt %. Preferably, alkylbenzene sulfonates have a $C_{10}$-$C_{14}$ alkyl group. Preferably, the detergent composition comprises at least 3 wt % nonionic surfactants, preferably at least 5 wt %, preferably at least 6 wt %; preferably no more than 15 wt %, preferably no more than 12 wt %, preferably no more than 10 wt %. Preferably, a nonionic surfactant contains from one to ten polymerized ethylene oxide units per molecule, preferably from three to eight. Preferably, a nonionic surfactant has a $C_6$-$C_{12}$ alkyl group, preferably $C_7$-$C_{10}$, preferably $C_8$. Preferably, the alkyl group is a branched alkyl group. Preferably, the nonionic surfactant also contains from three to seven polymerized units of propylene oxide, preferably as a block between the alkyl group and the polymerized ethylene oxide units.

Preferably, the detergent further comprises from 1 to 12 wt % of a $C_1$-$C_4$ glycol solvent, preferably propylene glycol, preferably from 2 to 11 wt %, preferably from 3 to 10 wt %. Preferably, the detergent further comprises from 0.5 to 8 wt % of a $C_2$-$C_4$ alcohol solvent, preferably 1 to 5 wt %. Preferably, the alcohol solvent is ethanol or isopropanol, preferably ethanol.

Preferably, the pH of the detergent composition is from 6 to 11, preferably from 7 to 10, preferably from 7.5 to 9.5. Suitable bases to adjust the pH of the formulation include mineral bases such as sodium hydroxide and potassium hydroxide; ammonium hydroxide; and organic bases such as mono-, di- or tri-ethanolamine; or 2-dimethylamino-2-methyl-1-propanol (DMAMP). Mixtures of bases may be used. Suitable acids to adjust the pH of the aqueous medium include mineral acid such as hydrochloric acid, phosphorus acid, and sulfuric acid; and organic acids such as acetic acid. Mixtures of acids may be used. The formulation may be adjusted to a higher pH with base and then back titrated to the ranges described above with acid.

When builders are present in the compositions of the invention, preferred builders include citrates, phosphates, carbonates, aluminosilicates, organic phosphonates, carboxylates, polycarboxylates (e.g., polyacrylic acid or maleic/(meth)acrylic acid copolymers), polyacetyl carboxylates, or mixtures thereof. The term "carbonate(s)" refers to carbonate, bicarbonate, percarbonate, and/or sesquicarbonate. Builders may be added as salts or in the acid form. Preferably, the carbonates or citrates are sodium, potassium or lithium salts; preferably sodium or potassium; preferably sodium. Preferred builders include sodium carbonate, sodium bicarbonate, sodium citrate, or mixtures of two or more thereof. Preferably, the amount of builder when present in the inventive compositions may range, for instance, from 0.1 to 10 wt %, preferably from 0.5 to 5 wt %, based on the total weight of the detergent composition.

Co-builders may also be included in the compositions of the invention. Preferred co-builders include, but are not limited to, polyacrylic acid and its copolymers, sulfonates, phosphonates (e.g., sodium diethylenetriamine pentamethylene phosphonate). Preferably, the amount of co-builders, when present in the inventive composition, may range, for instance, from 0.1 to 20 wt %, alternatively from 0.5 to 10 wt %, based on the total weight of the detergent composition.

EXAMPLES

Example 1

Several classes of stains (bleachable, enzymatic and greasy) were studied using two HDL formulations, one with the polymer and one without the polymer to benchmark the effect of the polymer in the HDL formulation.

| Stain | Category | HSD[1] | Delta (Cleaning improvement compared to HDL without hybrid polymer) |
|---|---|---|---|
| Fruit Juice | Bleachable | 0.9 | 2.3 |
| Tomato Puree | Bleachable | 6.5 | 7.6 |
| Grass | Enzymatic | 2.5 | 3.8 |
| French Mustard | Enzymatic | 3.2 | 5.9 |
| Sheep Blood | Enzymatic | 2.4 | 2.5 |
| Make up | Greasy | 4.6 | 7.0 |
| Tea | Bleachable | 3.9 | 3.6 |
| Red wine | Bleachable | 2.2 | 0.4 |
| Coffee | Bleachable | 4.1 | 0.5 |
| Chocolate | Enzymatic | 2.6 | 0.8 |
| Grass and Mud | Enzymatic | 1.5 | 1.5 |
| Carrot Baby Food | Enzymatic | 5.4 | 1.4 |
| Unused Motor Oil | Greasy | 3.0 | 0.8 |
| Cooked Beef Fat | Greasy | 4.2 | 3.5 |

[1]HSD (high significant difference) value permits determination of the significant differences between each pair of formulations for each stain using Tukey's HSD test with a 5% level of significance Of the total of 14 stains studied, significant improvement in 6 stains was observed (shown in the upper part of the table, Delta > HSD) and the rest were not significantly improved. The addition of hybrid polymer didn't have negative effect on primary cleaning performance.

HDL Formulation Used in this Study:

| Order of addition | Dow HDL ingredient | Commercial name | Active content (%) | Amount added (% of formulation) |
|---|---|---|---|---|
| 1 | DI water | — | 100 | 30.00 |
| 2 | Linear alkyl benzene sulfonate | NANSA HS-80 | 80 | 17.80 |
| 3 | Nonionic surfactant | ECOSURF EH-6 | 100 | 8.25 |
| 4 | Propylene glycol | — | 100 | 5.00 |
| 5 | Trisodium citrate dihydrate | — | 100 | 2.00 |
| 6 | Fatty acid C12-18 | PALMERA B1220 | 100 | 6.40 |
| 7 | Ethanol | — | 100 | 2.00 |
| 8 | Sodium xylenesulfonate | ELTESOL SX30 | 30 | 6.33 |
| 9 | NaOH (30% solution) | — | 30 | until pH 8.5 |
| 10 | Enzyme Lipase | LIPEX 100L | | 0.5 |
| 11 | Amylase | STAINZYMES Plus 12L | | 0.5 |
| 12 | Protease | LIQUANASE Ultra | | 1 |
| 13 | Polymer A[1] | | 50 | 10 |
| 14 | DI water | — | 100 | up to 100% |
| | TOTAL | | | 100.00 |

[1]Polymer A = 30% acrylic acid/70% acrylate ester of a 12 mole ethoxylate of a mixed $C_{12}$-$C_{15}$ alcohol, Mw = 2,000; supplied in propylene glycol solution

The invention claimed is:

1. A liquid detergent comprising: (a) from 30 to 80 wt % water; (b) from 5 to 50 wt % surfactants; and (c) from 0.5 to 10 wt % of an acrylic polymer comprising from 20 to 50 wt % polymerized units of (meth)acrylic acid and from 50 to 80 wt % polymerized units of a monomer of structure $H_2C{=}C(R)CO_2(CH_2CH_2O)_n(CH(R')CH_2O)_mR''$; wherein R is H or $CH_3$, R' is $C_1$-$C_2$ alkyl; R" is $C_8$-$C_{22}$ alkyl or $C_8$-$C_{16}$ alkylphenyl; n is an average number from 6-30 and m is an average number from 0-10, provided that n≥m and m+n is 6-30.

2. The detergent of claim 1 in which R" is $C_8$-$C_{18}$ alkyl and n is from 8 to 20.

3. The detergent of claim 2 in which the acrylic polymer has no more than 0.1 wt % crosslinker.

4. The detergent of claim 3 comprising from 1 to 8 wt % of the acrylic polymer.

5. The detergent of claim 4 comprising from 35 to 70 wt % water.

6. The detergent of claim 5 comprising from 10 to 40 wt % surfactants.

7. The detergent of claim 6 in which the acrylic polymer comprises from 23 to 40 wt % polymerized units of (meth) acrylic acid and from 60 to 77 wt % polymerized units of a monomer of structure $H_2C{=}C(R)CO_2(CH_2CH_2O)_n(CH(R')CH_2O)_mR''$.

8. The detergent of claim 6 in which m is no greater than one and R' is methyl.

9. The detergent of claim 8 comprising from 40 to 65 wt % water.

* * * * *